US009773479B2

(12) United States Patent
Lee et al.

(10) Patent No.: US 9,773,479 B2
(45) Date of Patent: Sep. 26, 2017

(54) BOHEMIAN INSTRUMENTS

(71) Applicant: Bohemian Guitars Inc., Marietta, GA (US)

(72) Inventors: Adam Lee, Marietta, GA (US); Shaun Lee, Marietta, GA (US)

(73) Assignee: Bohemian Guitars Inc., Atlanta, GA (US)

( * ) Notice: Subject to any disclaimer, the term of this patent is extended or adjusted under 35 U.S.C. 154(b) by 15 days.

(21) Appl. No.: 14/579,418

(22) Filed: Dec. 22, 2014

(65) Prior Publication Data

US 2015/0179152 A1 Jun. 25, 2015

Related U.S. Application Data

(60) Provisional application No. 61/919,995, filed on Dec. 23, 2013.

(51) Int. Cl.

| | |
|---|---|
| ***G10H 1/32*** | (2006.01) |
| ***G10D 3/00*** | (2006.01) |
| ***G10D 1/00*** | (2006.01) |
| ***G10H 3/18*** | (2006.01) |
| *G10D 1/08* | (2006.01) |

(52) U.S. Cl.
CPC ..... *G10D 3/00* (2013.01); *G10D 1/00* (2013.01); *G10H 1/32* (2013.01); *G10H 3/18* (2013.01); *G10D 1/085* (2013.01)

(58) Field of Classification Search
CPC ..... G10D 1/08; G10D 1/085; G10D 1/005; G10D 3/00; G10D 15/00; Y10T 29/49574; G10H 1/32
USPC ..... 84/267, 902
See application file for complete search history.

(56) References Cited

U.S. PATENT DOCUMENTS

2006/0123971 A1* 6/2006 Moghaddam ..... G10D 1/085 84/290
2012/0318121 A1* 12/2012 Mittelstadt ..... G10H 1/342 84/743
2014/0345441 A1* 11/2014 Ostosh ..... G10D 1/085 84/723

OTHER PUBLICATIONS http://news.bbc.co.uk/2/hi/africa/1998890.stm, Allie May 20, 2002.*

* cited by examiner

*Primary Examiner* — Kimberly Lockett
(74) *Attorney, Agent, or Firm* — Yuri L. Eliezer; Bekiares Eliezer LLP

(57) ABSTRACT

A Bohemian Instrument may be a musical instrument, acoustic or electric, with a metallic semi-hollow or hollow body. The Bohemian Instrument may comprise a neck extending from the body. In various embodiments, the Bohemian Instrument may comprise, but not be limited to, for example, a through-body neck, extending from the head of the neck into the body of the instrument. Within the body, the Bohemian Instrument may comprise a frame reinforcing at least one inner-edge of the body. In various embodiments, the frame within the body may be comprised of wood and be connected to, or comprise a part of, the through-body neck. By reinforcing the body, the frame also serves to improve a resonation quality of the hollow or semi-hollow metallic body. In turn, the Bohemian Instrument's unique and distinct sound is further articulated.

11 Claims, 10 Drawing Sheets

BOHEMIAN INSTRUMENTS

RELATED APPLICATION

Under provisions of 35 U.S.C. §119(e), the Applicant claims the benefit of (PCT or) U.S. provisional application No. 61/919,995, filed Dec. 23, 2013, which is incorporated herein by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to stringed musical instruments construction and design.

BACKGROUND

Stringed instruments such as guitars, ukuleles, banjos and the like have long enjoyed popularity among experienced and aspiring musicians. A string instrument (or stringed instrument) is a musical instrument that produces sound by means of vibrating strings, usually over a sounding board and/or resonating chamber. Plucking, bowing, and striking are the three most common techniques used in creating musical sounds from a stringed instrument.

String instruments produce sound from one or more vibrating strings, transferred to the air by the body of the instrument or by a pickup device in the case of amplified instruments. A vibrating string makes only a very quiet sound on its own. Thus string instruments are usually constructed in such a way that this sound is coupled to a hollow resonating chamber, a sounding board, or both.

It is sometimes said that the sounding board or sound-box "amplifies" the sound of the strings. Technically speaking, no actually amplification occurs, because all of the energy to produce sound comes from the vibrating string. Instead, the sounding board of the instrument provides a larger surface area to create sound waves than that of the string. A larger vibrating surface moves more air, hence produces a louder sound.

Achieving a tonal characteristic that is effective and pleasing to the ear is an art, and the makers of string instruments often seek special woods to this end, particularly spruce (chosen for its lightness, strength and flexibility) and maple (a very hard wood).

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

A Bohemian Instrument may be a musical instrument, acoustic or electric, with a metallic semi-hollow or hollow body. The Bohemian Instrument may comprise a neck extending from the body. In various embodiments, the Bohemian Instrument may comprise, but not be limited to, for example, a through-body neck, extending from the head of the neck into the body of the instrument. Within the body, the Bohemian Instrument may comprise a frame reinforcing at least one inner-edge of the body. In various embodiments, the frame within the body may be comprised of wood and be connected to, or comprise a part of, the through-body neck. By reinforcing the body, the frame also serves to improve a resonation quality of the hollow or semi-hollow metallic body. In turn, the Bohemian Instrument's unique and distinct sound is further articulated.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
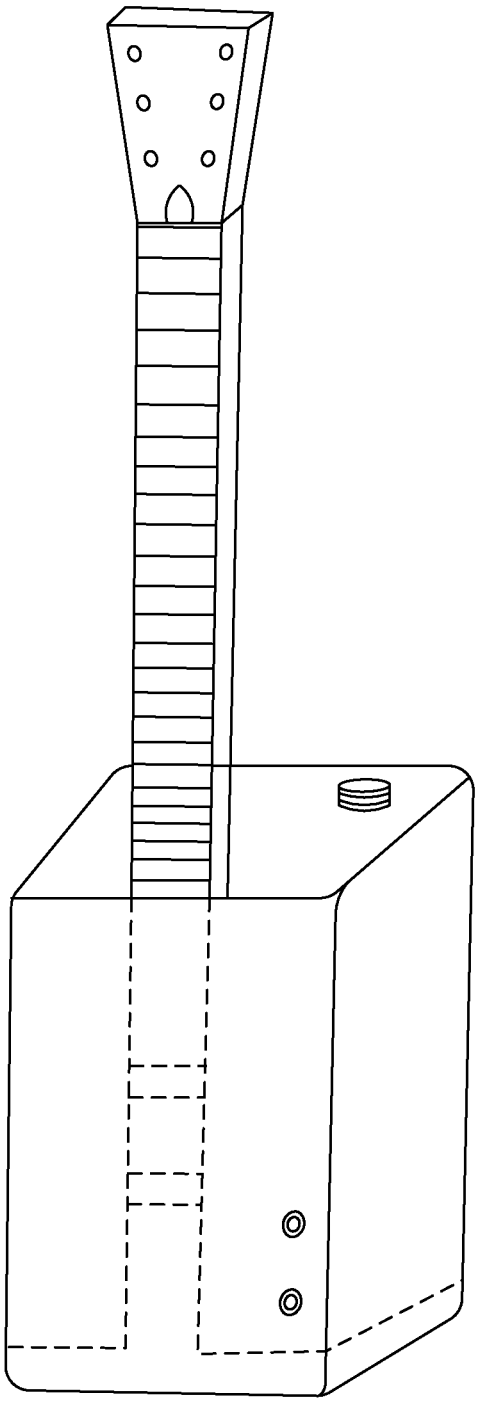
FIG. 1 illustrates a third embodiment of a Bohemian Instrument.

The following detailed description refers to the accompanying drawings. Wherever possible, the same reference numbers are used in the drawings and the following description to refer to the same or similar elements. While many embodiments of the disclosure may be described, modifications, adaptations, and other implementations are possible.

For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

I. Overview

A Bohemian Instrument consistent with embodiments of the present disclosure may be provided. A Bohemian Instrument may be any instrument comprising a hollow or semi-hollow, metallic body with a neck extending from the body. Though the term "Bohemian™ Instrument" is used throughout this disclosure, the term is used to refer to any instrument adhering to the embodiments in this specification. Moreover, the term is not construed as limiting upon the subject matter disclosed herein. All rights to the term "Bohemian™ Instrument" or "Bohemian Instrument™" are expressly reserved by the Applicant, and its use in the present disclosure shall not be construed to grant a license, of any kind, to the term.

Accordingly, a Bohemian Instrument may be a fully-functional musical instrument, acoustic or electric, with a metallic semi-hollow or hollow body. The Bohemian Instrument may comprise a neck extending from the body. In various embodiments, the Bohemian Instrument may comprise, but not be limited to, for example, a through-body neck, extending from the head of the neck into the body of the instrument.

Still consistent with embodiments of a Bohemian Instrument, at least one pickup may be integrated into the instrument. The pickup may be integrated into the neck, at a portion of the neck that overlaps with the body of the instrument. In various other embodiments, where, for example, the instrument does not comprise a through-body neck, the pickup may be integrated into the body.

The instrument may be, for example, but not limited to a guitar, ukulele, bass, or any other stringed instrument designed in accordance to the embodiments disclosed herein. Due to the Bohemian Instrument's metallic body design, the instrument produces a unique sound, readily identifiable as a Bohemian Instrument. A Bohemian Instrument consistent with embodiments of the disclosure produces the unique sound by virtue of, in part, its unique size, shape, and materials used to construct the instrument.

Within the body, the Bohemian Instrument may comprise a frame reinforcing at least one inner-edge of the body. In various embodiments, the frame within the body may be comprised of wood and be connected to, or comprise a part of, the through-body neck. By reinforcing the body, the frame also serves to improve a resonation quality of the hollow or semi-hollow metallic body. In turn, the Bohemian Instrument's unique and distinct sound is further articulated.

The frame may further serve to connect and stabilize the neck to the base. The neck may comprise guitar elements (e.g., strings, frets, and tuning pegs) which may enable a user to play the instrument in a fashion similar to that of a guitar. The body may produce and resonate sound in response to the vibrations of strings on the neck.

A Bohemian Guitar may be a metallic canned body guitar. The Bohemian Instrument may be constructed by modifying and reconstituting a pre-existing can (e.g., an oil can or lunch box) to act as the body, a factory-made guitar neck to act as the neck, and a specifically designed frame to fit the body and neck together into a single piece of equipment.

II. Bohemian Instrument Body

FIG. 1 illustrates one embodiment of a Bohemian Instrument. A Bohemian Instrument body may comprise a hollow or semi-hollow enclosed form. A Bohemian Instrument body may come in a variety of shapes and sizes. The body may take the shape of, for example, but not limited to, a hyper-rectangle or cylinder, such as a box or a can. In some embodiments of the present disclosure, the body may comprise, for example, a metallic can. The metallic can may have been previously used to hold liquids or chemicals. As part of a design of some Bohemian Instruments, the body may comprise a lid that is used for opening the can, thereby exposing the interior of the body. The body may be made from a variety of materials, including but not limited to, metal, tin, aluminum, plastic, carbon fiber, or wood.

The body may further comprise a bridge and a plurality of dials. In some embodiments of the present disclosure, a bridge may be affixed to the front surface of the body. In various embodiments, the bridge may be operative to hold a plurality of strings in place by means of a saddle. The bridge may be further operative to transfer the vibration from the strings to a soundboard. The bridge saddle may be adjustable such that the distance between the strings and fret-board may vary in order to tune the instrument.

In some embodiments the body may also comprise a "whammy bar" which may be operable to allow a user to change the tension of the strings, thereby enabling a user to modulate the pitch of the Bohemian Instrument. A plurality of strings may be attached to the front surface or the base of the body. The plurality of strings, extending from the surface of the body, may be drawn across the bridge, down the length of the neck across a fret-board, and ultimately be attached to a headstock.

Consistent with embodiments of the present disclosure, a Bohemian Instrument body may further comprise an access panel which may be operable to provide a temporary opening into interior of the body. As illustrated in FIG. 3 and FIGS. 7-10, in some embodiments the access panel may be detachable from the surface of the body. In other embodiments the access panel may remain affixed to the body by, for example, hinges, and it may be enabled to swing open and shut.

Figure 4:
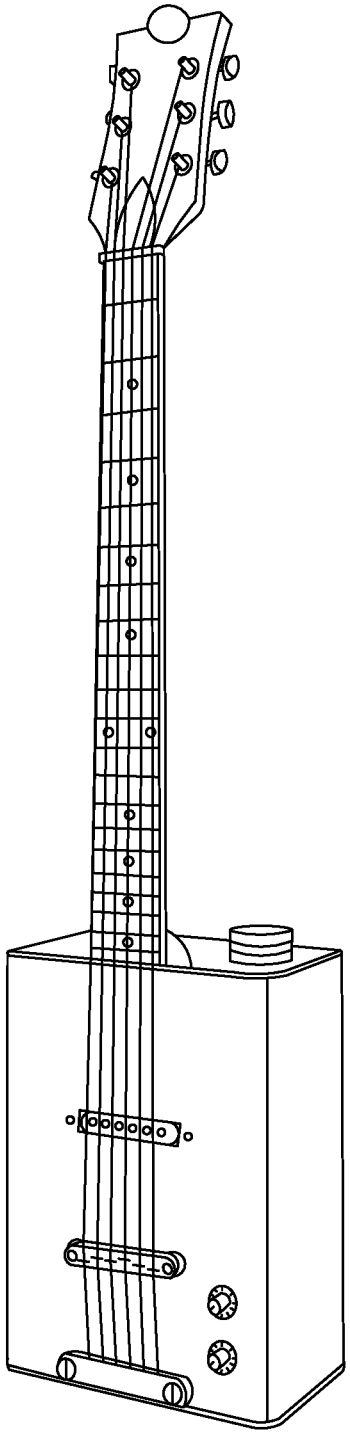
FIG. 4 is a first three-dimensional rendering of an embodiment of a Bohemian Instrument.
Figure 5:
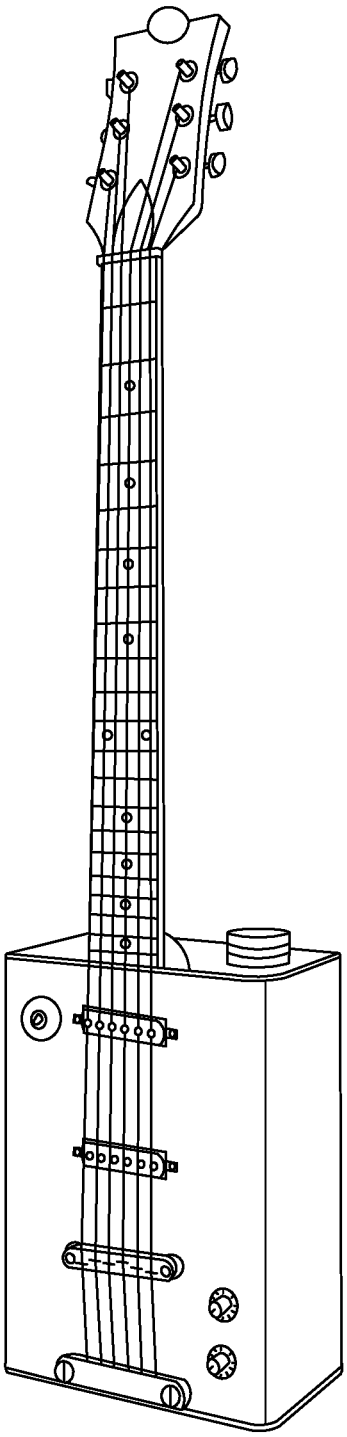
FIG. 5 is a second three-dimensional rendering of an embodiment of a Bohemian Instrument.
Figure 6:
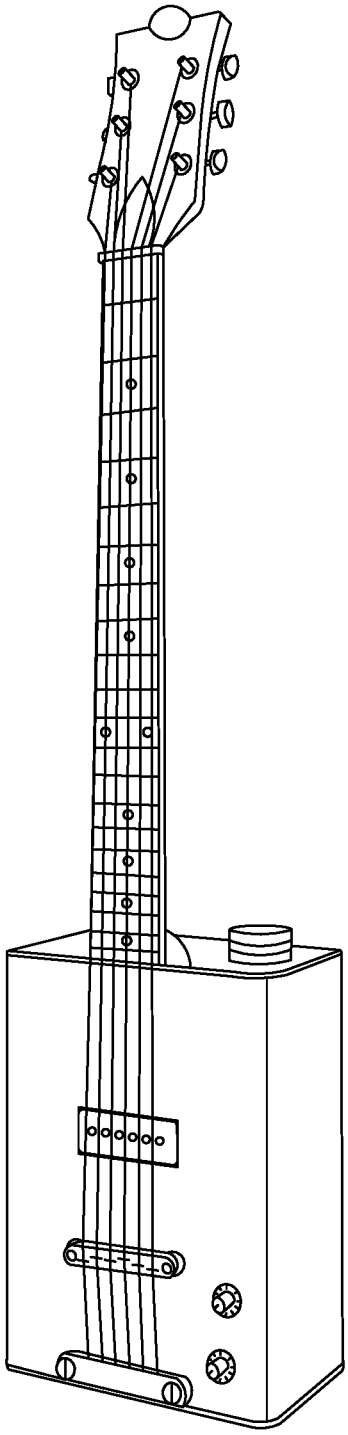
FIG. 6 is a third three-dimensional rendering of an embodiment of a Bohemian Instrument.

In some embodiments of the present disclosure, the body may comprise one or more transducers (or "pickups") designed to convert string vibrations into an electric signal. The transducers may be integrated into the neck, at a portion of the neck that overlaps with the body of the instrument. In various other embodiments, where, for example, the instrument does not comprise a through-body neck, the transducers may be integrated into the body. The "pickups" or transducers may be paired with electronics, circuitry or wiring to further enable their use. FIGS. 4-6 illustrate various different types of pickups that may be integrated with the Bohemian Instrument. Moreover, as illustrated in FIGS. 4-6, the body of the Bohemian instrument may comprise a plurality of switches to control the operation and functionality of the pickups.

The body may further comprise circuitry designed to amplify the signal from the transducers. The body may further comprise electric ports or connections designed to output the signal from the circuitry signal to speakers. The access panel may provide a user of the Bohemian Instrument with access to these electrical components.

Still consistent with embodiments of the Bohemian Instrument, the electrical ports of the instrument may interface the instrument with a pre-amplifier or amplifier, thereby amplifying and outputting the sound produced by the instrument. A plurality of controls and dials may be provided on the instrument to control the volume and tone outputted by the electronic components of the instrument. The controls and dials may enable a user to adjust various properties associated with the instrument, including pickup selectors in embodiments with more than one pickup.

III. Bohemian Instrument Frame

Embodiments of the present disclosure may comprise a frame. A Bohemian Instrument frame may provide structure and stability to the Bohemian Instrument while serving to connect the neck to the body. A frame may comprise a T-shaped member, as illustrated in FIG. 1.

The top end of the "T" shape of the frame may be affixed to the base of the body and the bottom end of the "T" shape of the frame may be affixed to the neck. In other embodiment consistent with the present disclosure, the frame may comprise other shapes, for example, the portion of the frame affixed to the body may have an "X" shape. Such an "X" shape may form, for example, trusses connecting to the corners or vertices of an internal surface of the body. The frame may be comprised of a variety of materials, including but not limited to, wood, metal, tin, aluminum, carbon fiber or plastic. In various different embodiments of the present disclosure, the frame may be comprised of a variety of different shapes, sizes, materials and designs. Such variations in the frame may allow for a variety in the quality and characteristics of sounds produced by a Bohemian Instrument, as well as adding to, or modifying the structural integrity of the body.

Moreover, in some embodiments, the circular lid at the top of the body as can be seen in FIGS. 4-10 may be adjusted to control the sound and tone produced by the body. This may be achieved by, for example, controlling the size of an opening enabling different sound resonation characteristics.

The frame may be affixed to the body and neck by means of, for example, but not limited to, glue, adhesive, fasteners, nails, or screws. In other embodiments, the frame may be affixed to the body and/or neck through a manufacturing process such as molding, welding, or the like.

Figure 7:
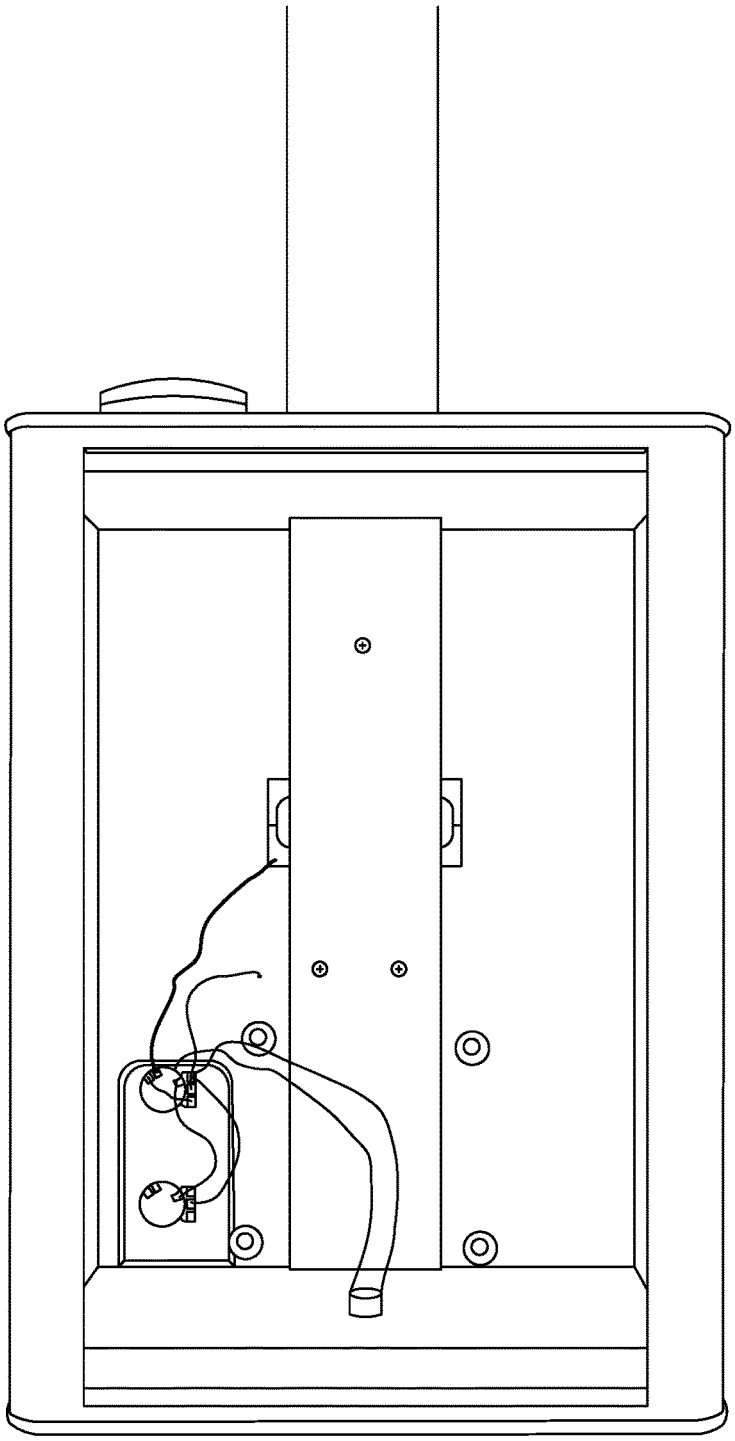
FIG. 7 is a first three-dimensional interior view of an embodiment of a Bohemian Instrument.
Figure 8:
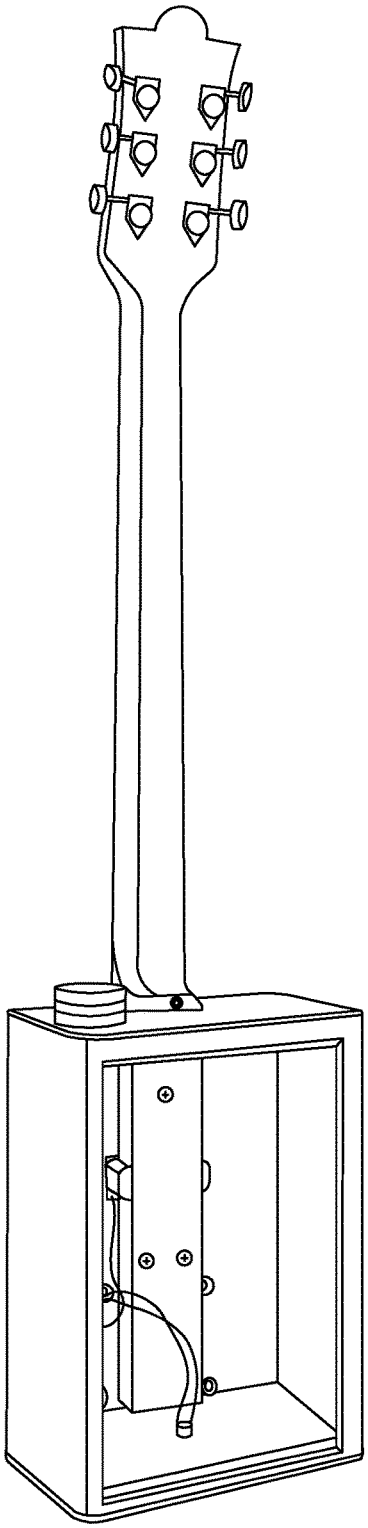
FIG. 8 is a second three-dimensional interior view of an embodiment of a Bohemian Instrument.
Figure 9:
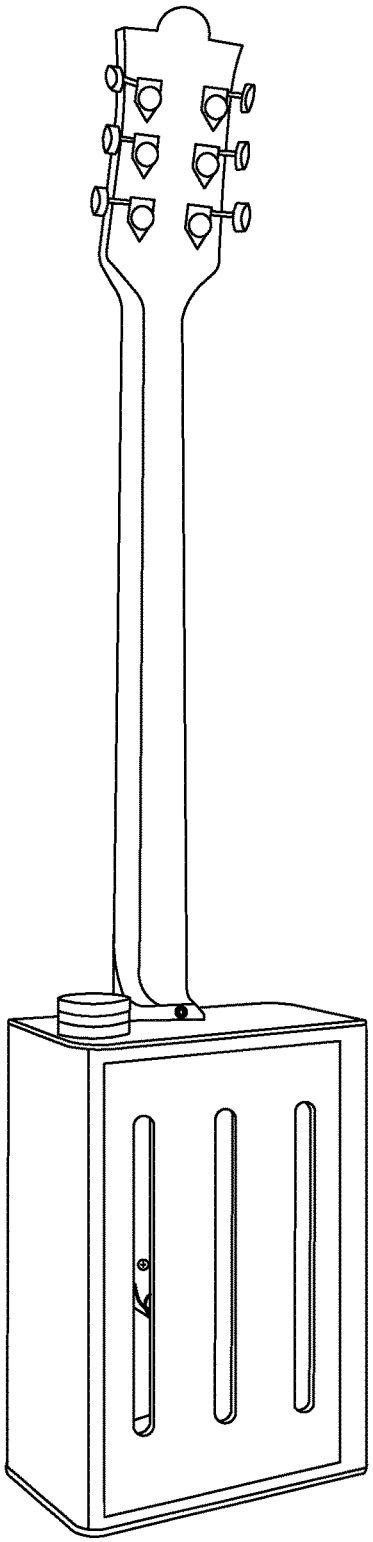
FIG. 9 is a first three-dimensional rear view of an embodiment of a Bohemian Instrument.
Figure 10:
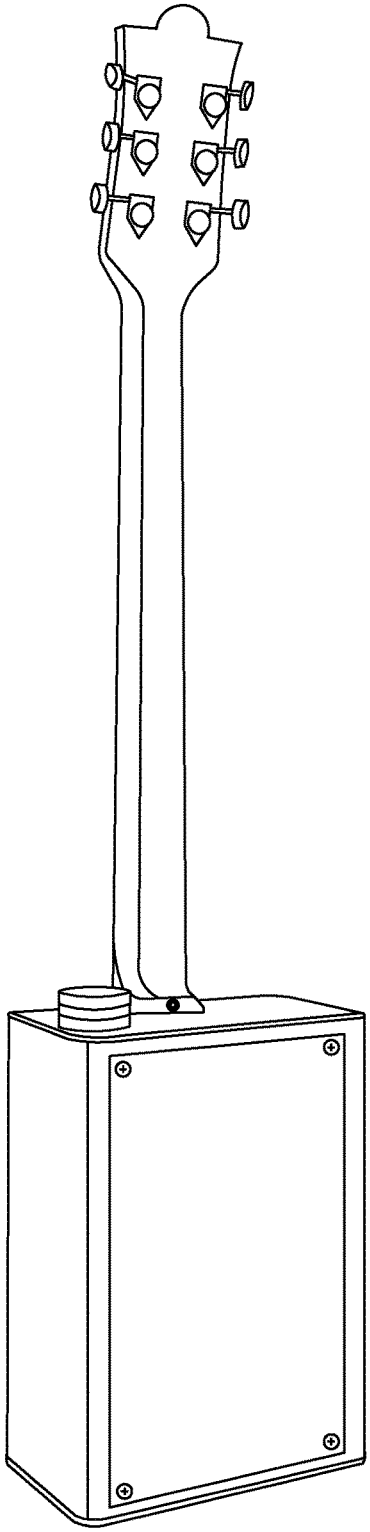
FIG. 10 is a second three-dimensional rear view of an embodiment of a Bohemian Instrument.

Accordingly, the Bohemian Instrument may comprise the frame reinforcing at least one inner-edge of the body. By reinforcing the body, the frame also serves to improve a resonation quality of the hollow or semi-hollow metallic body. In turn, the Bohemian Instrument's unique and distinct sound is further articulated. FIGS. 7 and 8 illustrate the interior of an embodiment of the Bohemian instrument. The interior of the instrument, as illustrated, includes pickups carved into the neck. Moreover, the interior of the instrument body is reinforced with a wooden frame. As shown in FIG. 9, the back panel may also be reinforced with a wooden frame.

IV. Bohemian Instrument Neck

A Bohemian Instrument neck may comprise for example, but not limited to, some or all of the following: a neck member, a headstock, a nut, a fret-board, a plurality of frets, plurality of strings, a bridge, a truss rod, and a plurality of inlays. The neck may be a pre-made component, manufactured by, for example, a guitar company, and thus may comprise a typical assembly of a guitar neck, headstock, etc.

Figure 2:
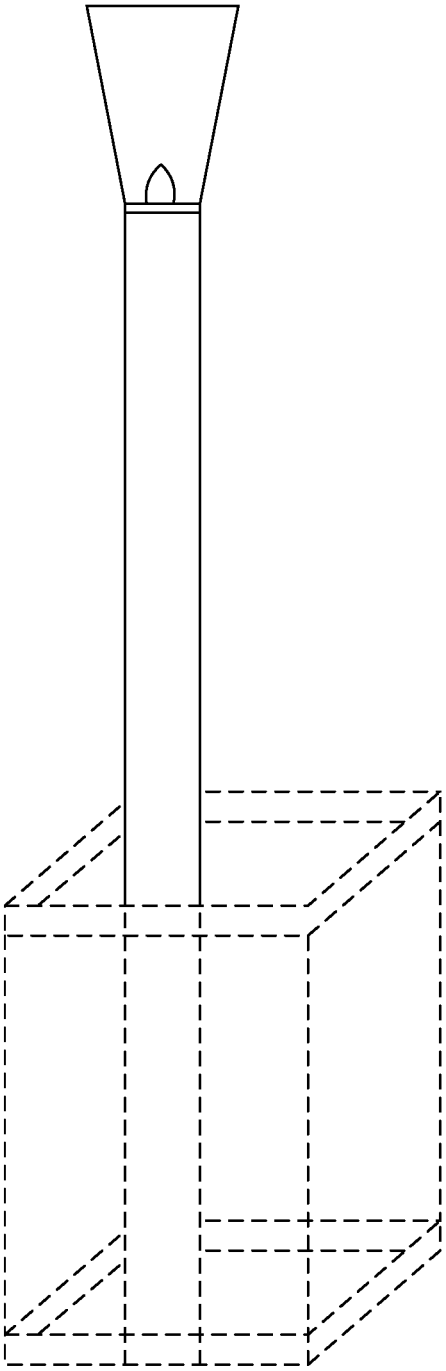
FIG. 2 illustrates a fourth embodiment of a Bohemian Instrument.
Figure 3:
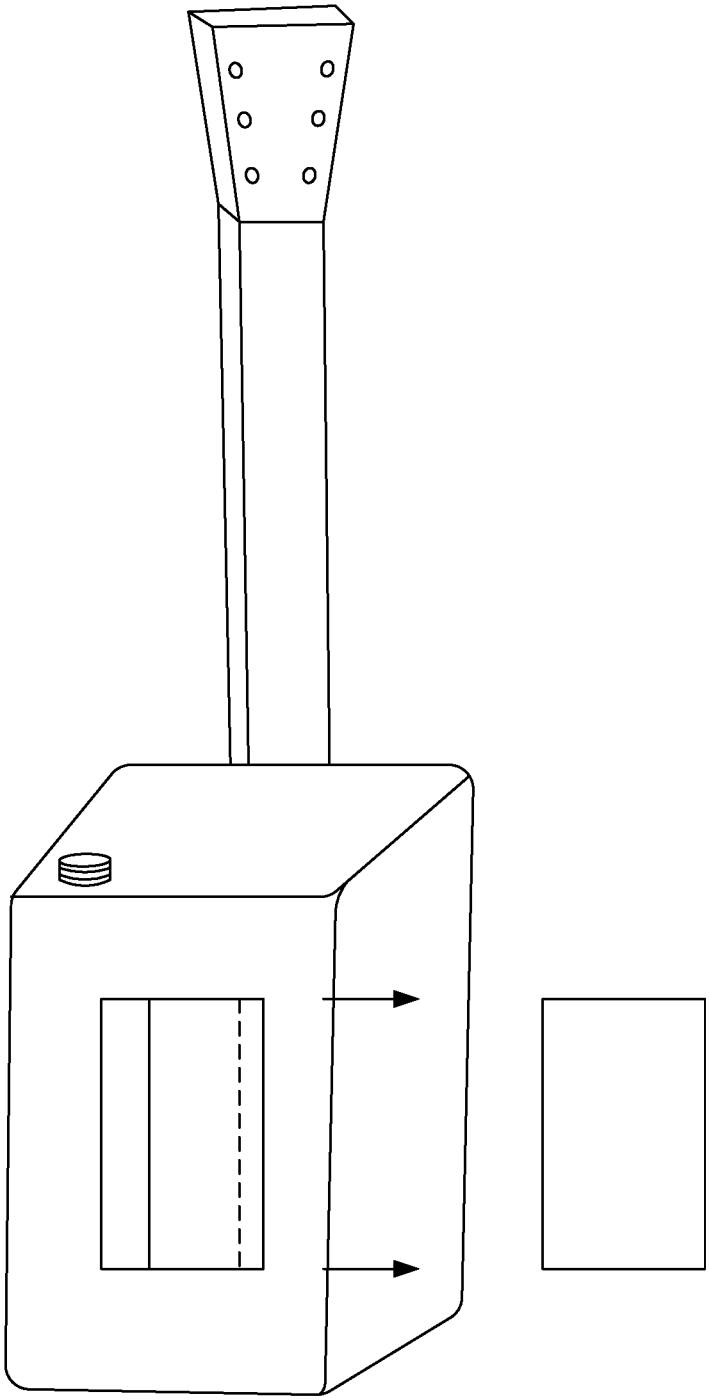
FIG. 3 illustrates a fifth embodiment of a Bohemian Instrument.

In some embodiments of the present disclosure, the base of the neck may be affixed to the top surface of the body, as is illustrated in FIG. 2. Furthermore, the rear surface of the neck may be affixed to a surface of the frame, wherein the frame is also affixed to one or more internal surfaces of the body. The neck may be affixed to the body and frame by means of, for example, but not limited to, glue, adhesive, fasteners, nails, or screws. In other embodiments, the neck may be affixed to the body and/or frame through a manufacturing process such as molding, welding, or the like.

Still consistent with embodiments of the present disclosure, the neck may comprise carve-outs for the placement of at least one pickup. In the through-body neck configuration, the carve-outs may be located over a portion of the body of the Bohemian Instrument.

V. Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

We claim the following:

1. An apparatus comprising:

a metallic body having a substantially hollow interior;

a through-body neck having a first end extending from the metallic body and a second end extending into the metallic body, wherein the through-body neck comprises;

a first portion that protrudes from the metallic body to the first end, the first end having at least one tuning peg;

a second portion that extends into the substantially hollow interior of the metallic body to the second end, the second portion having at least one attachment location for at least one electronic component; and a wooden frame adhered to at least one inner edge of the metallic body.

2. The apparatus of claim 1, wherein the wooden frame is attached to the through-body neck.

3. The apparatus of claim 1, wherein the metallic body comprises at least one door configured to expose the interior of the metallic body.

4. The apparatus of claim 1, wherein the metallic body comprises at least one lid which is configured to expose the interior of the metallic body.

5. The apparatus of claim 1, wherein the metallic body comprises at least one electronic component configured to provide an electronic signal corresponding to a sound produced with the apparatus.

6. An apparatus comprising:

a metallic body having a substantially hollow interior;

a through-body wooden neck having a first end extending from the interior of metallic body and a second end extending concluding within the substantially hollow interior of the metallic body, wherein the through-body wooden neck comprises:

a first portion that protrudes from the interior metallic body to the first end, the first end having at least one tuning peg;

a second portion that extends into the interior of metallic body to the second end, the second portion having at least one at least one attachment location for at least one pick-up; and at least one pickup integrated into the second portion of the through-body wooden neck.

7. The apparatus of claim 6, further comprising a wooden frame adhered to at least one inner edge of the metallic body.

8. The apparatus of claim 7, wherein the wooden frame is attached to the through-body wooden neck.

9. The apparatus of claim 6, wherein the metallic body comprises at least one door configured to expose the interior of the metallic body.

10. The apparatus of claim 6, wherein the metallic body comprises at least one lid which is configured to expose the interior of the metallic body.

11. An apparatus comprising:

a metallic body having a substantially hollow interior and a wooden frame adhered to at least one inner wall of the metallic body;

a wooden through-body neck, integrated into the wooden frame, having a first end extending from the interior of metallic body and a second end extending concluding within the substantially hollow interior of the metallic body, wherein the wooden through-body neck comprises:

a first portion that protrudes from the interior metallic body to the first end, the first end having at least one tuning peg;

a second portion that extends into the interior of metallic body to the second end, the second portion having at least one integration point configured to receive at least one pick-up; and at least one pickup integrated into the second portion of the wooden through-body neck.

* * * * *